US005499301A

United States Patent [19]

Sudo et al.

[11] Patent Number: 5,499,301

[45] Date of Patent: Mar. 12, 1996

[54] ACTIVE NOISE CANCELLING APPARATUS

[75] Inventors: Yuko Sudo, Kanagawa; Susumu Saruta; Yasuyuki Sekiguchi, both of Osaka, all of Japan

[73] Assignee: Kabushiki Kaisha Toshiba, Kawasaki, Japan

[21] Appl. No.: 323,730

[22] Filed: Oct. 20, 1994

Related U.S. Application Data

[63] Continuation of Ser. No. 947,170, Sep. 18, 1992, abandoned.

[30] Foreign Application Priority Data

Sep. 19, 1991 [JP] Japan ..... 3-239784
Mar. 23, 1992 [JP] Japan ..... 4-065259

[51] Int. Cl.[6] ..... G10K 11/16
[52] U.S. Cl. ..... 381/71
[58] Field of Search ..... 381/71, 94

[56] References Cited

U.S. PATENT DOCUMENTS 4,566,118 1/1986 Chaplin et al. ..... 381/71
5,125,241 6/1992 Nakanishi et al. ..... 381/71
5,129,003 7/1992 Saruta ..... 381/71
5,170,433 12/1992 Elliott et al. ..... 381/47

FOREIGN PATENT DOCUMENTS 3-191275 8/1991 Japan .

OTHER PUBLICATIONS

Saruta et al., "Refrigerator Equipped with Active Noise Control System," International Symposium on Active Control of Sound and Vibration, pp. 509–512 (Apr. 1991).

*Primary Examiner*—Forester W. Isen
*Attorney, Agent, or Firm*—Foley & Lardner

[57] ABSTRACT

An active noise cancelling apparatus for actively controlling noise generated by a compressor, where noise is apt to externally leak from an opening portion of a machine chamber storing the compressor driven by an A.C. power supply. The active noise cancelling apparatus includes: a microphone, provided in the vicinity of the opening portion, for detecting noise generated by the compressor; fundamental wave component extracting portion for extracting a fundamental wave component of rotation frequency of the compressor, from a sound signal of the noise detected by the microphone; periodic signal generating circuit for a periodic signal correlative to the fundamental wave component extracted by the fundamental wave component extracting portion; periodic signal outputting circuit for outputting a predetermined periodic signal by means of comparing a phase of the periodic signal generated by the periodic signal generating circuit with a phase of the fundamental wave component; uncancelled sound extracting portion for extracting noise having been not cancelled, excluding the fundamental wave component; sound source waveform generating circuit for forming a harmonics component from the signal outputted by the fundamental wave component extracting circuit; control signal generating circuit for correcting a control signal outputted from the sound source waveform generating circuit, based on a signal from the uncancelled sound extracting portion and for generating the corrected signal in a feedback manner; and a loudspeaker for outputting the control signal generated from the control signal correcting circuit.

10 Claims, 10 Drawing Sheets

39
55
COMPRESSOR
41
45
51
49
45a
FULL-WAVE RECTIFYING CKT
73
A/D CONVERTER
75
71
SOUND WAVEFORM GENERATING CKT
77
85
ELECTRO-MAGNETIC SOUND FILTER
85a
ROTATION SOUND FILTER
85b
HIGH-PASS FILTER
79
TRANSFER CHARACTERISTIC FILTER
81
87
SILENCING ERROR IDENTIFICATION ADAPTIVE FILTER
83
57
BAND-PASS FILTER
59
A/D CONVERTER
61
SOUND SOURCE PERIODIC SIGNAL STABILIZING CKT
63
SOUND SOURCE WAVEFORM GENERATING CKT
65
53

ACTIVE NOISE CANCELLING APPARATUS

This application is a continuation of application Ser. No. 07/947,170, filed Sep. 18, 1992, now abandoned.

BACKGROUND OF THE INVENTION

1. Field of the Invention

The present invention relates to an active noise control apparatus, and particularly to an active noise cancelling apparatus which actively cancels periodic noise generated from a rotation drive portion disposed in a machine chamber, by means of outputting a control signal of opposite phase but same amplitude as the noise signal.

2. Description of the Prior Art

A refrigerator at home and an air-conditioning equipment in a building are used continuously regardless of seasons, and noise therefrom is a problem. In this case, the troublesome noise source is a machine chamber which stores a rotary machine such as a motor.

To cope with the problem of the noise from the machine chamber, the conventional techniques include reducing the noise of the rotary machine itself, providing sound absorbing and insulating members within the machine chamber, and improving the noise absorbing level in the machine chamber and sound transmission loss.

However, there opening portions are provided for radiating heat caused by the rotary machine in the machine chamber, and thus the noise leaks outside. Thus there are limitations in conventional noise prevention techniques, particularly in reducing the noise level at the low-frequency band.

Recently, along with technical advances in electronics-applied technology, especially processing circuits for acoustic data and acoustic control, attention is being directed to an active control technique in which reduction of noise is attempted by utilizing interference of sound waves. In the active control technique, sound from a sound source is detected by sound source detecting means such as a microphone provided in a specific position and the sound detected is converted to an electric signal. The electric signal is processed by a computing element, so that an artificial sound having an opposite phase but same amplitude than that from the sound source at a control point is produced to attenuate the noise by interfering the artificial sound with the noise. The artificial sound is outputted from control sound outputting means such as a loudspeaker.

Namely, in the active control technique, the microphone is provided near the rotary machine of noise source, and the sound caused by driving the rotary machine is detected by the microphone. The electric signal which is processed by the computing element so as to damp the detected sound is outputted by the loud speaker so that both sounds are interfered attenuating the noise which is to be emitted outside.

An adaptive-type active control technique is also available where a noise-cancelling level at a noise cancelling point according to noise cancelling effect responsive to time lapse and change in sound is detected by a sensor connected to a control-sound generating filter in a feedback manner so as to maximize the noise cancelling effect.

The low-frequency noise which is controversial nowadays has a long wavelength as sound, thereby being apt to permeate the sound absorbing members and diffract an obstacle, so that there is not much expected in terms of noise preventing techniques such as using a noise shielding member or sound absorbing member. In contrast, the active control technique is effective at a low frequency.

FIG. 1 shows an example of such active control system. There are arranged a noise source 5 in an end of a space 3 within a duct 1, and an opening portion 7 in other end. There is provided a noise cancelling system 9 for cancelling noise generated by the noise source 5. In the noise cancelling system 9, there are provided a microphone 11, at point Ps of the duct 1, for detecting noise generated by the noise source 5, a control portion 13 for processing a signal detected by the microphone 11 so that a sound pressure thereof is zero at point Po near the opening portion 7 by sound wave interference, and a loudspeaker 15, mounted to the duct 1, for generating a control sound in the space 3. Thereby, a sound wall is formed at point Po which becomes a noise cancelling point, so that the noise is confined inside the duct without being radiated outside and the noise is cancelled.

A microphone 17 provided at point Po serves to detect the noise which remained uncancelled (not cancelled even after the above noise cancelling process) and the microphone 17 is also needed for obtaining a filter processing characteristics at the control portion 13. In order to form a signal for cancelling the noise at the control portion 13, it is necessary to measure in advance the acoustic characteristics of the duct 1, the microphone 11 and the microphone 17 and to obtain the characteristics for the filter which processes the sound source signal based on the acoustic characteristics in the control portion 13. A method for obtaining such characteristics is described as follows.

First, when the loudspeaker 15 generate a random noise, an acoustic transfer function Gao (referred to as simply the transfer function hereinafter), including the characteristics of the loudspeaker, between points Pa and Po is measured. Second, while the random noise is being generated from the loudspeaker 15, transfer function Gso between points Ps and Po is measured. Then a signal detected at point Ps is processed. Let a transfer function which represents up to the point where the control sound is generated at point Pa be Gsa. Gsa is an acoustic transfer function between points Ps and Pa. There is a relation such that:

$$Gso=Gsa\cdot Gao \tag{1}$$

Thus, transfer function G for the control portion 13 is one which a phase which opposite to the phase of Gsa and G is obtained by:

$$G=-Gsa=-Gso/Go \tag{2}$$

On the other hand, in order to maintain great noise cancelling effect in the course of forming the control sound, there is necessitated a function for automatic control which takes into account the time-lapse changes in the microphones 11, 17 and the loudspeaker 15 as well as changes in the acoustic function found in the space 3 responsive to a change in temperature and so on. Thus, the adaptive-type active control system is proposed therefor.

Referring to FIG. 2, in the adaptive-type active noise cancelling system, there is provided a sensor (microphone) at the noise cancelling point, through which the uncancelled noise is constantly monitored and fedback to the control portion so that a monitor signal thereof is minimized. In FIG. 2, elements such as the duct, microphones and loudspeaker are omitted.

In the adaptive-type active control system, transfer function Go from the loudspeaker to the noise cancelling point is measured in advance in a similar manner as with FIG. 1, and transfer function Go is set in a factor setting portion 19. Let a sound signal from the sound source be Sx, and a sound signal at the opening portion of the duct be Sy, there is a relation such that:

$$Sy=Gso\cdot Sx \tag{3}$$

In order to cancel sound signal Sy at the opening portion, it suffices to overlap sound signal –Sy which is opposite in phase but with same-amplitude as sound signal Sy, over the sound signal Sy at the opening portion of the duct. Let Sa be a signal which is outputted to the loudspeaker as the control sound, then –Sy is expressed by:

$$-Sy=Go\cdot Sa \tag{4}$$

Moreover, referring to FIG. 2, let the characteristic of a filter 21 for cancelling noise, namely, transfer function thereof be G, then the control sound Sa is expressed by:

$$Sa=G\cdot Sx=-Gso/Go\cdot Sx \tag{5}$$

Substitute equation (5) into equation (4), to obtain:

$$Sy=(-G)\cdot Gao\cdot Sx \tag{6}$$

Hence, as evident from equation (6), transfer function –G is obtained from Go–Sx where sound signal Sx from the sound source is filter-processed by transfer function Gao of the factor setting portion 19. Then, the characteristics of the filter 21 for cancelling the noise is obtained by inverting the sign of the transfer function –G.

When the above-mentioned process is carried out by a digital filter instead, the characteristics of the filter for cancelling the noise is obtained as a filter factor, so that an inversion of the factor sign is obtained by subtracting each tap factor value from zero.

Moreover, when transfer function Gso is dislocated to Gsoa and an optimum value of characteristics for the noise cancelling filter is dislocated by ΔG to become Gnew from Gold, where Gnew=Gold–ΔG (7), Sya which is a signal uncancelled at the opening portion of the duct is expressed by:

$$Sya=Sx\cdot G\cdot Gao+Sx\cdot Gsoa \tag{8}$$

Hence, there is shown a relation at an optimum noise cancelling condition:

$$Sx\cdot(G-\Delta G)\cdot Gao+Sx\cdot Gsoa=0 \tag{9}$$

Eliminating Gsoa in equations (8) and (9), $$\begin{aligned} Sya &= Sx\cdot G\cdot Gao-Sx(G-\Delta G)\cdot Gao \\ &= (Sx\cdot Gao)\cdot\Delta G \end{aligned} \tag{10}$$

Gsoa is an acoustic transfer function between points Ps and Po whenever Gso is changed, as described below.

Hence, in the similar manner as with equation (6), in an adaptive filter 23 a dislocated component (ΔG) of transfer function is obtained from Go·Sx where sound signal Sx from the sound source is filter-processed by transfer function Gao of the factor setting portion 19, and Sya which is the uncancelled sound signal in the opening portion of the duct. Dislocated component ΔG is sent from the adaptive filter 23 to the noise cancelling filter 21, and Gnew representing the optimum value for the characteristics of the noise cancelling filter 21 can be obtained from equation (7).

Here, comparing equation (6) with equations (7) and (10), the initially obtained characteristics G for the noise cancelling filter 21 is, in equation (7), equivalent to:

$$Gold=0 \tag{11}$$

A process for cancelling noise can be shifted toward an optimum condition by repeating a process represented by equation (10) with an initial value for the characteristics of the noise cancelling filter being 0, and the factor-updating process represented by equation (7).

In reality, it is advantageous to adopt the following equation where feedback gain parameter A is multiplied by ΔG so as to improve the converging rate and stability:

$$Gnew=Gold-\mu\cdot\Delta G \tag{12}$$

However, in the above adaptive-type active control there are several problems as to practical use thereof, as explained below.

In detecting the noise from the sound source directly by the microphone and so on, howling may occur when not only noise of the rotary machine but also the control sound outputted form the loudspeaker are picked up by the microphone. In this case, the howling offsets the noise cancelling effect and noise cancelling effect is no longer available.

To solve such a problem, a vibration pickup sensor is provided for detecting vibration of the rotation drive portion (noise source) in order to detect only the rotary machine which is the sole sound source. Namely, the vibration pickup sensor comprising piezoelectric elements, etc. is directly mounted on the rotary machine, so that the noise generated from the rotary machine alone is detected and a noise-cancelling signal based on thus detected noise is generated, thereby cancelling noises without causing the howling to occur.

However, there are several disadvantages caused by employing the vibration pickup sensor which is directly mounted to the rotary machine, described as follows.

Since the rotary machine generates heat as usage thereof continues, it is necessary to use the pickup sensor which is heat-resistant against a high temperature, thus causing an increase of cost in designing and producing such heat-resistant pick up sensor. Moreover, in using the pickup sensor, there is, in general, a charge amplifier is used for amplifying the detection signal. However, since it is difficult to mount the charge amplifier near the rotary machine, the charge amplifier will have to be provided separately from the pickup sensor connected by a cable, so that a weak signal detected by the pickup sensor is affected by an unwanted electric noise.

In recent times, big refrigerators are desirable. Consequently, the size of the compressor in a refrigerator becomes bigger, thereby causing an increase in the noise and heat generated by the compressor. In order to cope with such large-sized compressors presenting the increased noise and heat, a plurality of opening portions have to be provided in the machine chamber where the compressor is housed.

As a result, in order to cancel noise of the compressor of the large-sized refrigerator, where there a plurality of radiating opening portions are provided, there is not enough noise cancelling capacity in a conventional active noise cancelling system which is primarily designed for the machine chamber with a single opening portion. Further, it will be costly to mount the conventional noise cancelling apparatus in a plurality of opening portions in the limited space provided.

SUMMARY OF THE INVENTION

In view of the foregoing problems, it is therefore an object of the present invention to provide an active noise cancelling apparatus capable of providing stable noise cancelling with the phase fluctuation of sound source being suppressed to a minimum and capable of providing proper noise cancelling without being affected by external disturbance such as footsteps, etc.

To achieve this object, there is provided a active noise cancelling apparatus which comprises: sound detecting means, provided in the vicinity of the opening portion, for detecting noise generated by the rotary machine; fundamental wave component extracting means for extracting a fundamental wave component of rotation frequency of the rotary machine, from a sound signal of the noise detected by the sound detecting means; periodic signal generating means for a periodic signal correlative to the fundamental wave component extracted by the fundamental wave component extracting means; periodic signal outputting means for outputting a predetermined periodic signal by means of comparing a phase of the periodic signal generated by the periodic signal generating means with a phase of the fundamental wave component; uncancelled sound extracting means for extracting noise which has not been cancelled, after a control signal is outputted from control signal outputting means, excluding the fundamental wave component; sound source waveform generating means for forming a harmonics component from the signal outputted by the fundamental wave component extracting means, the harmonics component being a sound source waveform which has a phase opposite to and a same amplitude with a sound source signal detected by the sound detecting means; control signal generating means for correcting a control signal outputted from the sound source waveform generating means, based on a signal from the uncancelled sound extracting means and for generating the corrected signal in a feedback manner; and output means for outputting the control signal generated from the control signal correcting means.

Other features and advantages of the present invention will become apparent from the following description taken in conjunction with the accompanying drawings.

DETAILED DESCRIPTION OF THE PREFERRED EMBODIMENTS

With reference to FIG. 3 through FIG. 13, embodiments of the present invention will be described.

Figure 1:
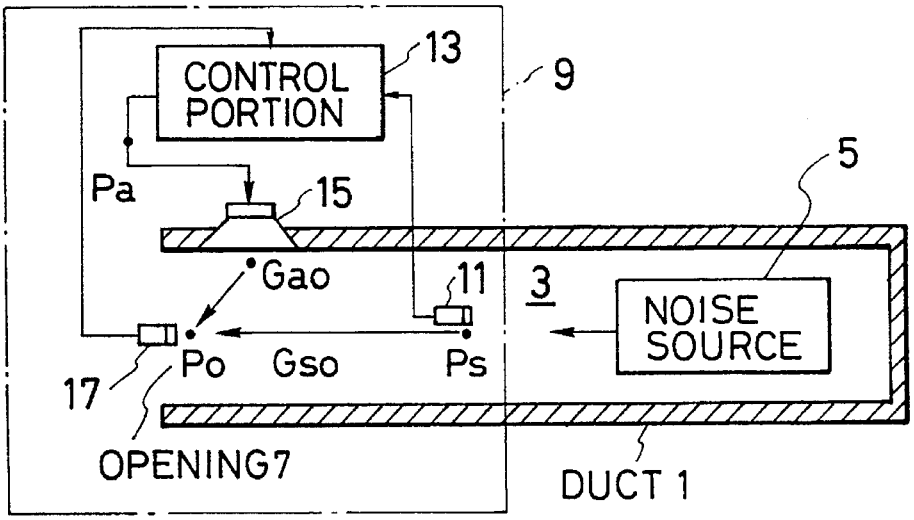
FIG. 1 PRIOR ART
FIG. 1 is an overview of the conventional active noise cancelling equipment.
Figure 2:
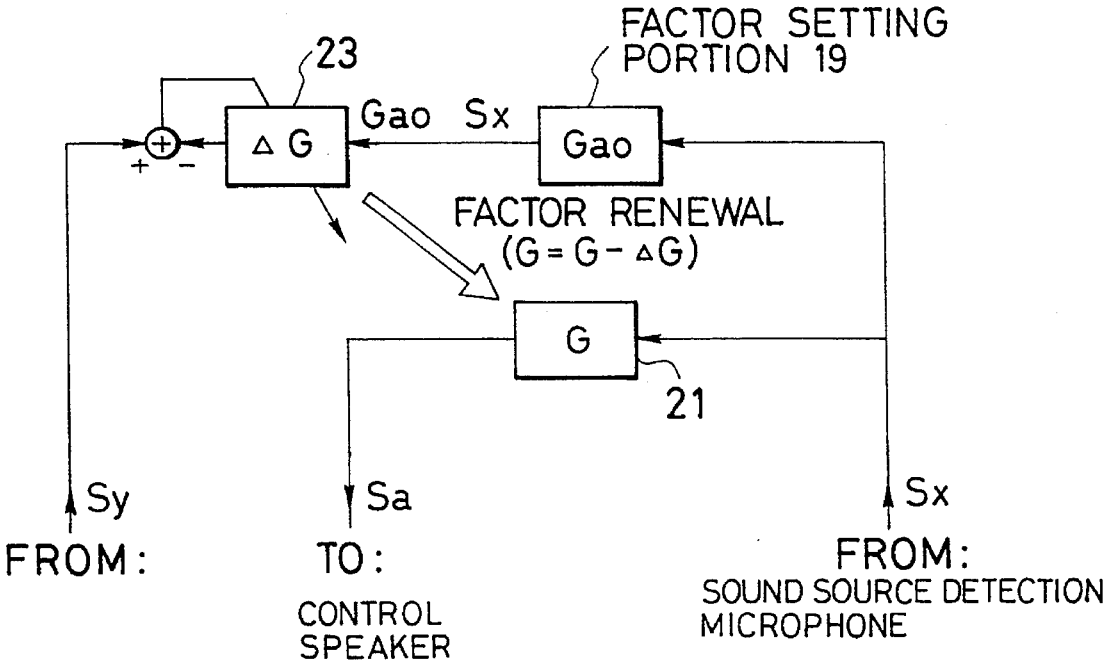
FIG. 2 PRIOR ART
FIG. 2 shows a block diagram of a control portion according to another conventional active noise cancelling equipment.
Figure 3:
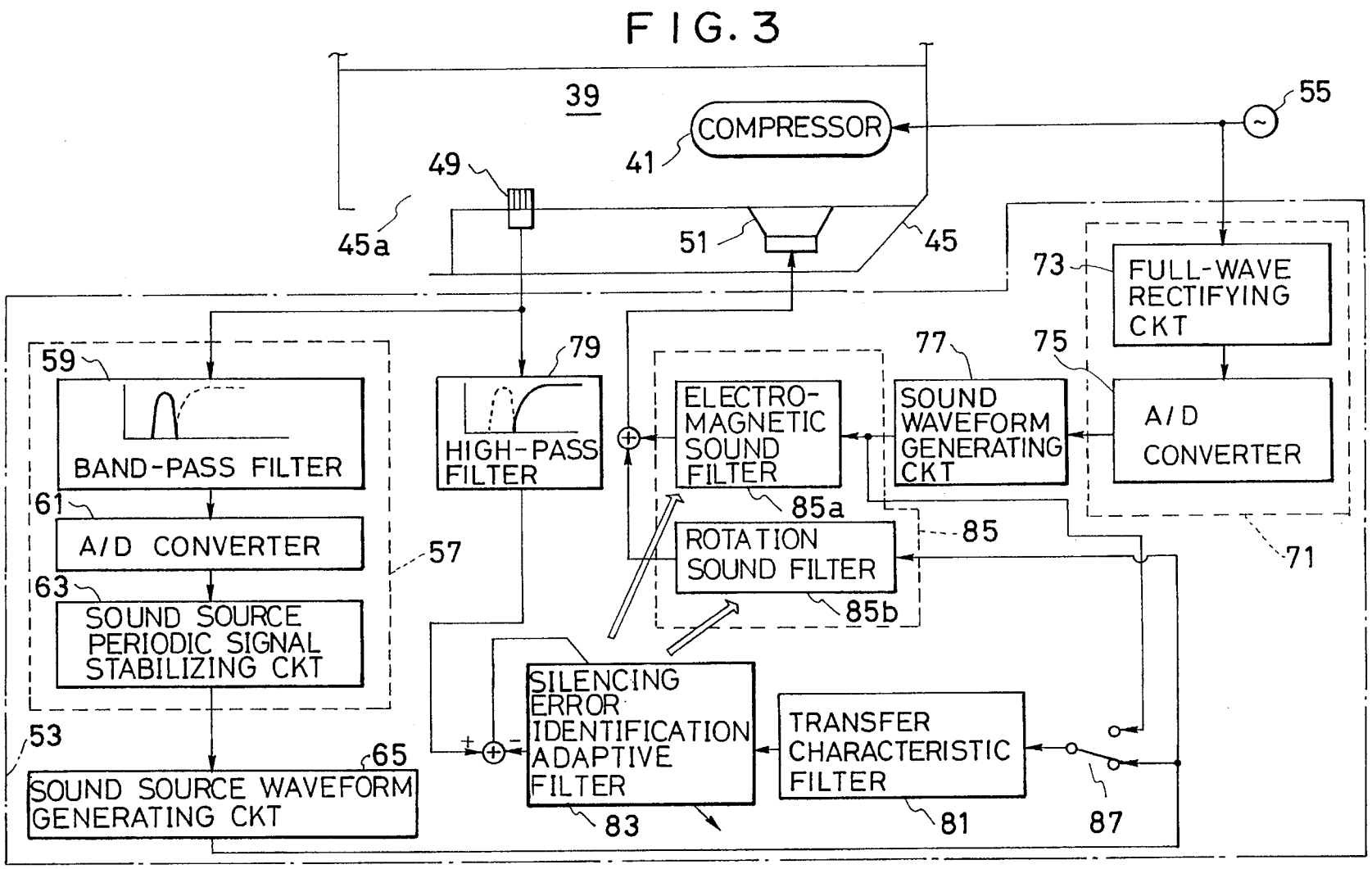
FIG. 3 shows an overview of an adaptive-type active noise cancelling apparatus according to an embodiment of the present invention.

An embodiment as illustrated in FIG. 3 adopts an adaptive-type active sound cancelling control against noise of periodicity generated from a compressor which is a rotation drive portion in a refrigerator.

Figure 5:
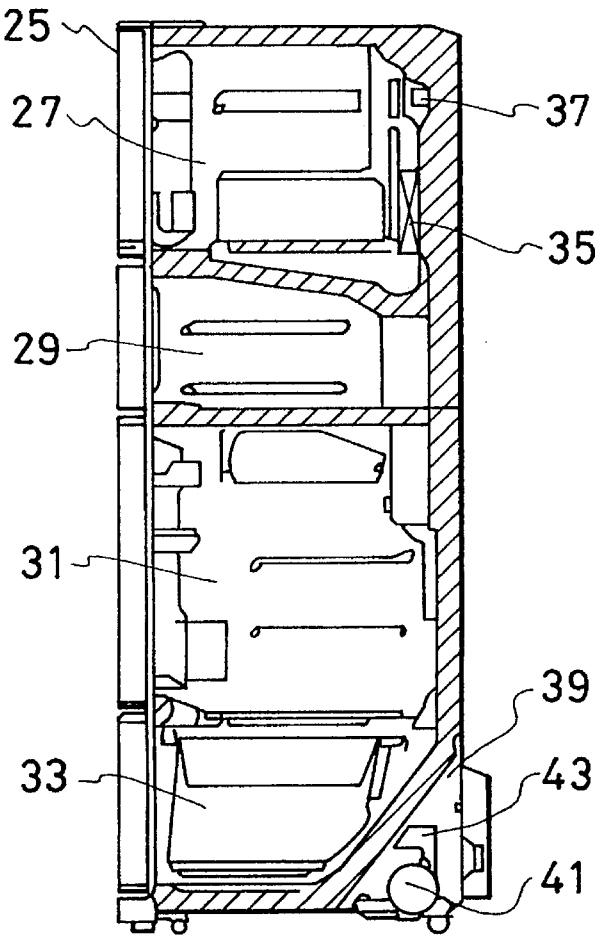
FIG. 5 shows a cross section of the refrigerator shown in FIG. 4.
Figure 4:
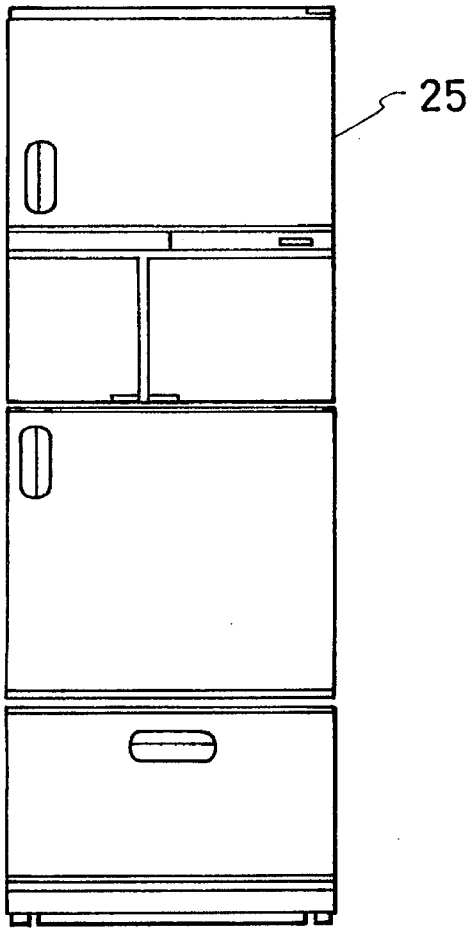
FIG. 4 shows a front view of a refrigerator utilizing the active noise cancelling apparatus shown in FIG. 3.

FIG. 4 shows an overview of the refrigerator. FIG. 5 shows a side view of FIG. 4. There are provided a freezer 27, a chilled chamber 29, a cold chamber 31 and a vegetable chamber 33 in the refrigerator body 25.

In the rear side of the refrigerator body 25, there is provided a cooling system therein. The cooling system includes a cooling unit 35 provided in the rear portion of the freezer 27. Cold air generated by the cooling unit 35 is supplied to the freezer 27, chilled chamber 29 and cold chamber 31 by means of a fan 37. In the lower rear side of the refrigerator body 25, there is provided a machine chamber 39 which encloses therein a compressor 41 for compressing and discharging cooling medium and a defrosted-water-evaporating unit 43 which stores the water after defrosting the cooling unit 35 and evaporates the stored water by means of heat generated from the compressor 41. The cooling medium discharged from the compressor 41 is supplied to the cooling unit 35 to be cooled through a cooling medium pipe (not shown) and then the heat exchange takes place between the cooling unit 35 and the inside of refrigerator by the fan 37 driven.

Figure 6:
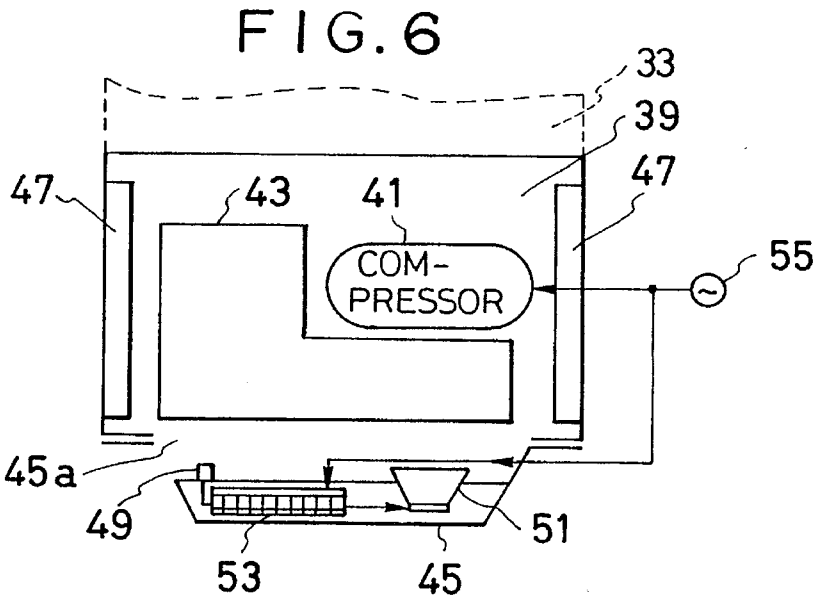
FIG. 6 shows a horizontal cross section of the refrigerator in the vicinity of a machine chamber where the active noise cancelling apparatus is housed.

FIG. 6 shows a horizontal cross section of the machine 39 positioned in the rear of the vegetable chamber 33. As FIG. 6 shows, there is provided an opening portion of rectangular shape in the rear side of the machine chamber 39. Such opening portion is closed by a machine chamber cover 45, thus providing a duct-shaped space therein. The machine chamber cover 45 is airtightly mounted to the edge of the opening portion, and a radiating opening portion 45*a* is formed in the left side of the opening portion. This is also illustrated in FIG. 5 where the radiating opening portion 45*a* is formed in a rectangular shape extending in the vertical direction. Namely, the machine chamber 39 is sealed with the machine chamber cover 45, except for the radiating opening portion 45*a*. The machine chamber cover 45 is generally made of material of high thermal conduction and having great transmission loss such as iron. As a one-dimensional flat progressive wave, noise from the compressor 41 is transferred to the radiating opening portion 45. Then, the noise is cancelled at the opening portion by an active noise cancelling apparatus, so that the machine chamber 39 is acoustically in a sealed condition. In both right and left sides inside the machine chamber there are provided sound absorbing members 47 to improve acoustic characteristics. The sound absorbing members 47 and the machine chamber cover 45 serve to absorb, shut out and damp a high-frequency sound among the noise generated from the compressor 41.

Referring to FIG. 6, mounted to the machine chamber cover 45 is the adaptive-type active noise cancelling apparatus which comprises: a microphone 49 serving as sound detecting means for detecting sound in the vicinity of the radiating opening portion 45*a;* a loudspeaker 51 serving as control sound output means for outputting control sound to cancel noise; and a control circuit 53 for receiving an output of detection signal from the microphone 49 and for then outputting a control signal. The configuration thereof allows for easy mounting and maintenance. A signal of a commercial power supply 55 which is supplied to the compressor 41 is also inputted to the control circuit 53.

FIG. 3 shows a schematic diagram of the control circuit 53 in the adaptive-type noise cancelling apparatus including a view of the machine chamber 39. The microphone provided in the vicinity of the radiating opening portion 45*a* in the machine chamber 39 also detects noise which is to be emitted outside. A detection output of the microphone 49 is inputted to a rotation frequency detecting means 57 which detects a rotating speed of the compressor 41. The rotation frequency detecting means 57 includes a band-pass filter 59 serving as fundamental wave component extracting means for extracting a fundamental wave component of the detected rotation sound, an A-D converter for digitizing an output signal of the band-pass filter 59 and a sound source periodic signal stabilizing circuit 63 for processing to stabilize a periodic signal of the sound source.

Figure 7:
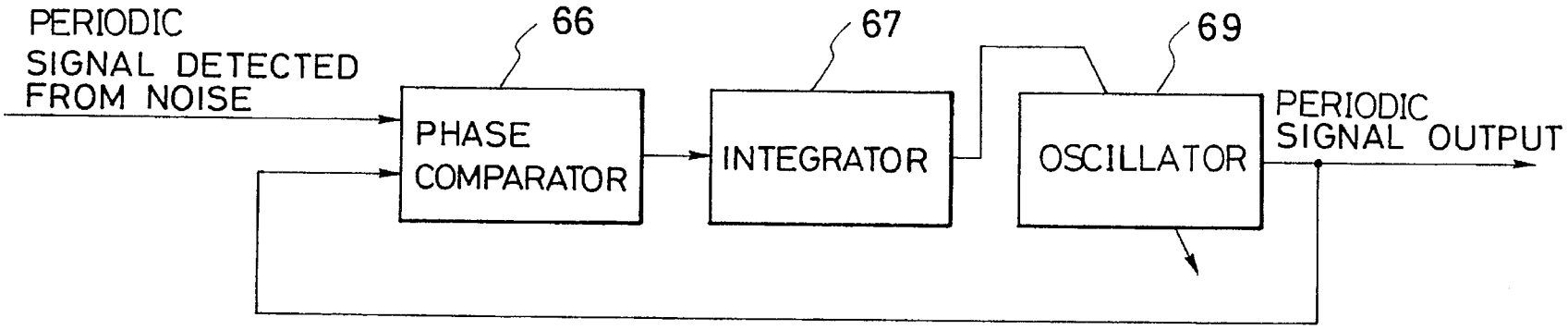
FIG. 7 shows a block diagram of a sound source periodic signal stabilizing circuit shown in FIG. 3.

Referring to FIG. 7, the sound source periodic signal stabilizing circuit 63 comprises a phase comparator 66, an integrator 67 and an oscillator 69. In other words, the sound source periodic signal stabilizing circuit 63 constitutes a so-called Phase Locked Loop (PLL) circuit. The phase comparator 66 and the integrator 67 constitute periodic signal outputting means and the oscillator 69 constitutes periodic signal generating means. A purpose for providing the sound source periodic signal stabilizing circuit 63 will be described as follows.

The band-pass filter 59 extracts a fundamental wave component of the rotation sound that is a sound source component, from a noise signal picked up by the microphone 49. However, there is a case where detection of the period of the sound component becomes unstable due to external background noises such as the air flow sound from an air-conditioning apparatus and a high-level impulse sound caused by people and automobiles passing by (the frequency component of the impulse being distributed over a wide band). In such cases, the harmonics component which is generated based on the period of the sound source component and is related to the sound component is also effected, thus causing a phase thereof to dislocate, so that the noise cancelling effect may be insufficient. In particular, since the air flow sound has a great deal of random component, not only does the phase of the sound source fluctuates at random so as to decrease the sound cancelling effect but also, to even make the noise heard more significantly, the level of the sound cancelling effect fluctuates randomly due to the random fluctuation in the level of the sound cancelling. In general, when the degree of phase dislocation becomes greater than 30 degrees, the noise cancelling capability has no effect and the noise will start to increase instead.

The phase dislocation is due to the deterioration of S-N ratio of the unwanted background noise and the wanted noise. In general, a signal passed after the band-pass filter 59 is binary-coded in the course of a process of detecting a period of the sound source. The binary-coding is carried out on a composite signal made of the sound source signal and the background noise signal based on certain threshold value. Thus, the phase dislocation easily occurs depending on how the sound source signal and the background noise signal are composed together. For the above-mentioned reasons, the sound source periodic signal stabilizing circuit 63 is provided.

In the sound source periodic signal stabilizing circuit 63, the periodic signal is constantly generated in the oscillator 69 which can externally control the frequency and phase. The output signal of the oscillator 69 and the periodic signal detected from the noise are compared in the phase comparator 66. The signal through the phase comparator 66 is fed to the integrator 67 so that the phase of the oscillator 69 is controlled to coincide with the periodic signal detected from the noise. The periodic signal extracted from the noise fluctuates due to the background noise and other external disturbance. The integrator serves to eliminate such fluctuation by taking a time average, etc. and to stabilize a feedback control. The configuration illustrated above can also be realized by a digital process by software.

The periodic signal outputted from the sound source periodic signal stabilizing circuit 63 is inputted to a sound source waveform generating circuit 65. In the sound source waveform generating circuit 65, the harmonics component having a uniform signal level in the noise cancelling band is formed from the inputted periodic signal by adjusting a pulse waveform having such component in the periodic signal. Then, a control sound waveform is formed which is of opposite phase and of same-amplitude as the noise (rotation sound) by means of a digital filter. The control sound signal is compounded with a control sound signal of the electromagnetic noise formed based on a power source frequency signal, so as to generate a sound-cancelling signal.

Figure 8:
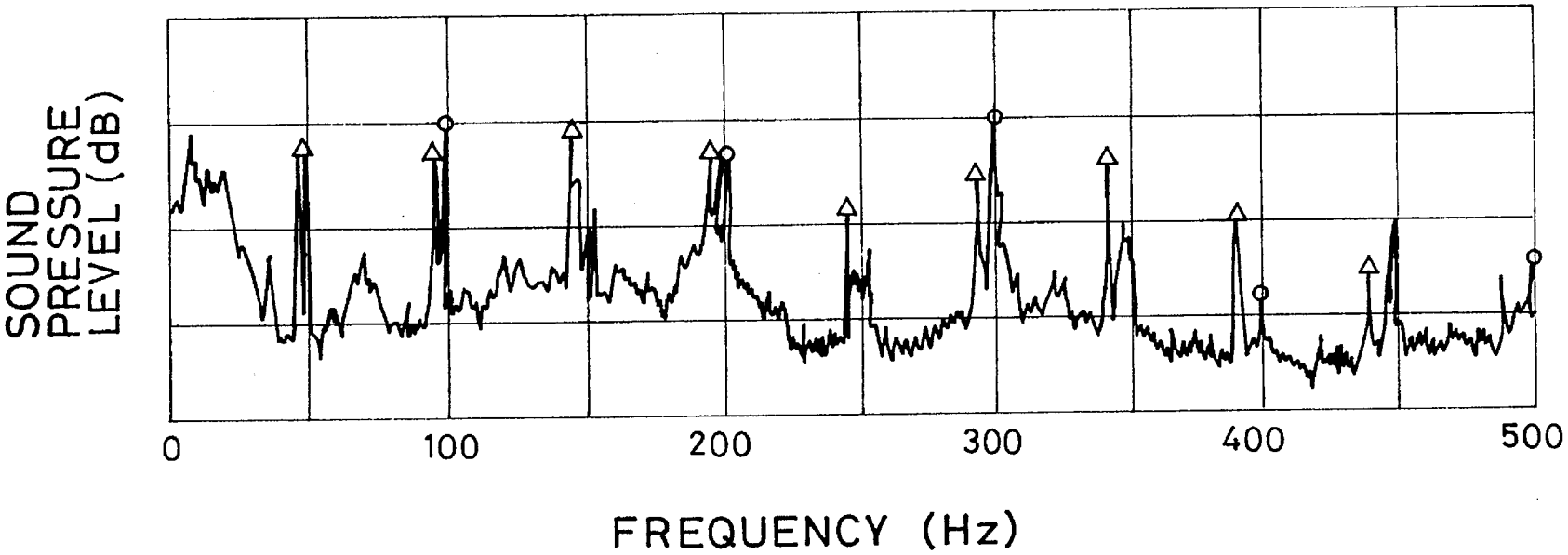
FIG. 8 shows a frequency distribution of the noise generated from a compressor of the refrigerator shown in FIG. 3.

When the power spectrum of the noise generated from the compressor 41 is frequency-analyzed within a range of 500 Hz, the result is shown in FIG. 8. Considering that the frequency of the A.C. power supply 55 is 50 Hz in this case, the electromagnetic noise due to the power source frequency is observed to have a frequency peak thereof at a frequency of even-integral multiples (see the points marked with a small circle in FIG. 8). On the other hand, a machine noise is caused by the rotation frequency which is small in the amount of skidding in a rotation portion compared to the power supply frequency, so that the machine noise has a frequency peak thereof at a frequency of integral multiples (see the points marked with a small triangle in FIG. 8). Besides the above electromagnetic noise and machine noise, modulation sounds appear in between the peaks. However, these sounds are almost negligible as a noise when both the electromagnetic noise and machine noise (rotation noise) are being suppressed.

Figure 9A:
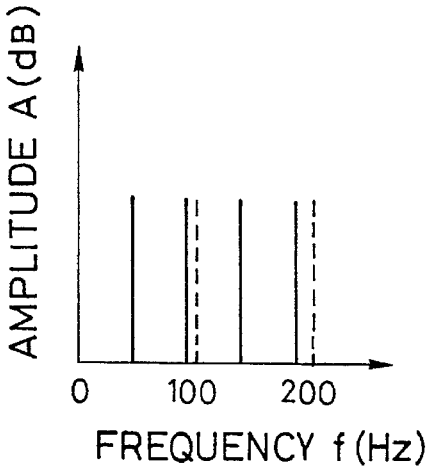
FIGS. 9A–E show a frequency distribution of the signal at each portion shown in FIG. 3.
Figure 9B:
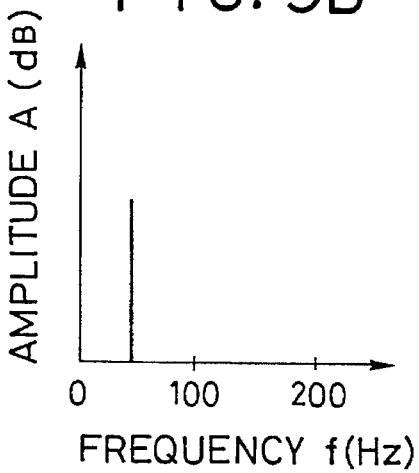
Figure 9C:
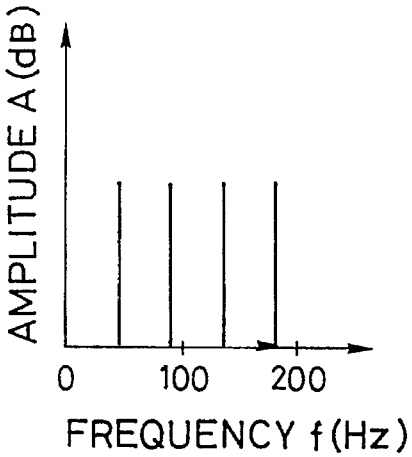
Figure 9D:
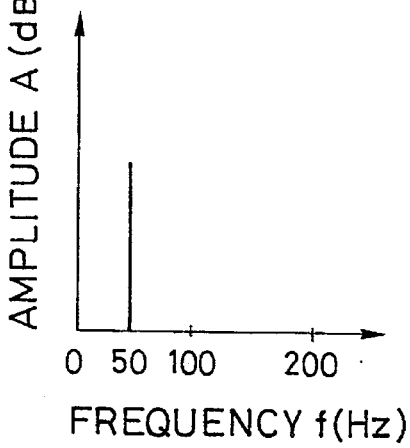

With reference to FIGS. 9A–E and FIGS. 10A–E, in order to detect these noise components without fail, the microphone 49 detects the noise which radiates externally from the machine chamber 39 amongst the noise accompanied by the rotation of the compressor 41 (FIG. 9A), then the noise is fed to the band-pass filter 59 so as to extract rotation frequency f1 of the compressor 41 (FIG. 9B). Power source frequency f0 is detected by power source frequency detecting means 71 (FIG. 9D). Namely, two fundamental frequencies which are rotation frequency f1 and power source frequency f0 (for instance, 50 Hz) are separately detected against the noise to be cancelled, and the control circuit 53 performs the following processing based on the above detected results.

The power supply frequency detecting means 71 comprises a full-wave rectifying circuit 73 for doubling a voltage waveform of power supply 55 by full-wave rectification and an A-D converter 75 for binary-coding and digitizing a signal obtained from the full-wave rectifying circuit 73. In a sound source waveform generating circuit 77, a harmonics component having a uniform signal level in the noise cancelling band is formed from the periodic signal outputted from the power supply frequency detecting means 71, by adjusting a pulse waveform having such component to the periodic signal. Then, a control sound waveform is formed, which is of opposite phase and of same-amplitude as the noise, by means of a digital filter.

Figure 9E:
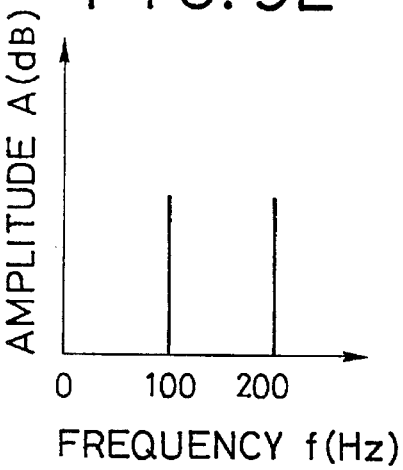

In the above processing, first of all, frequencies of integral multiples of the rotation frequency fl are obtained to be compounded with the rotation frequency f1. As for the power supply frequency f0, frequencies of even-integral multiples thereof are obtained to be compounded therewith (FIG. 9E). The f1 and f0 frequencies will be used as a dummy sound.

Figure 10A:
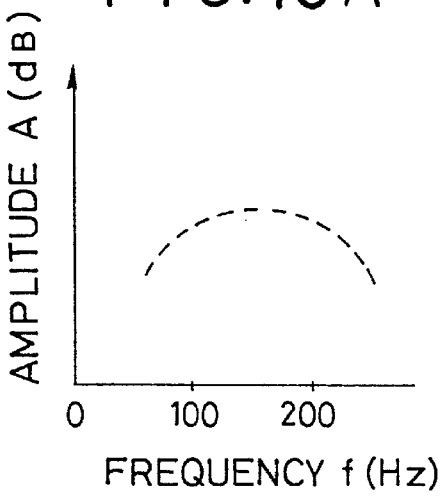
FIG. 10A–E show a frequency distribution and transfer function of the signal at each portion shown in FIG. 3.
Figure 10B:
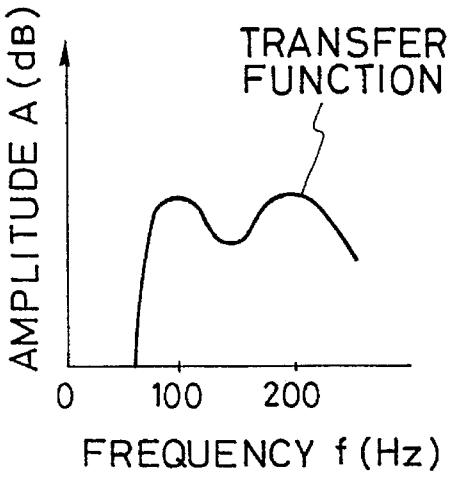
Figure 10C:
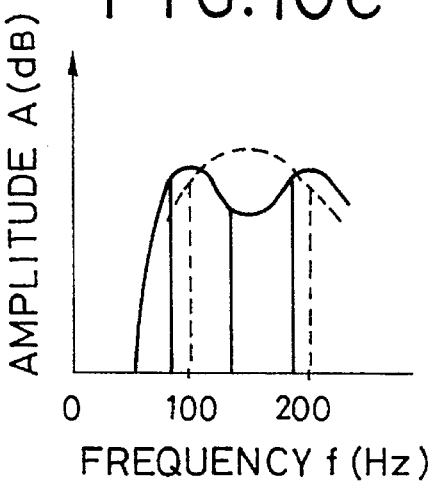
Figure 10D:
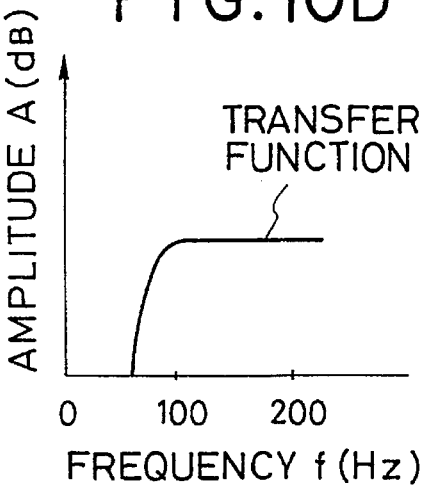

Next, the dummy sounds shown in FIG. 9C and FIG. 9E are multiplied by sound cancelling transfer functions based on the aforementioned sound cancelling principle (FIG. 10B and FIG. 10A) to generate a noise cancelling signal (FIG. 10C) by compounding a re-output signal. Now, the re-output signal is such that the dummy sound is multiplied by the transfer function. Specifically, the re-output signals are signals where FIG. 9C is multiplied by FIG. 10B, and FIG. 9E is multiplied by FIG. 10A.

In the opening portion 45*a*, a noise having not been cancelled is picked up by the microphone 49; such noise is also to be cancelled. However, the detection signal obtained by the microphone 49 is also used for detecting rotation frequency and such detection signal of the rotation frequency is needed in forming the noise cancelling waveform. Therefore, the rotation frequency signal need be left uncancelled (being not cancelled) even after noise cancelling control is completed. Thus, there is provided a high-pass filter 79 serving as uncancelled noise extracting means for cutting off the fundamental frequencies f0 and f1 from the detection signal of the microphone 49 (FIG. 10D), thereby the fundamental frequency components f0 and f1 are regarded as having been cancelled, so that the sound after passing the high-pass filter 79 is not so treated as to be cancelled.

Figure 10E:
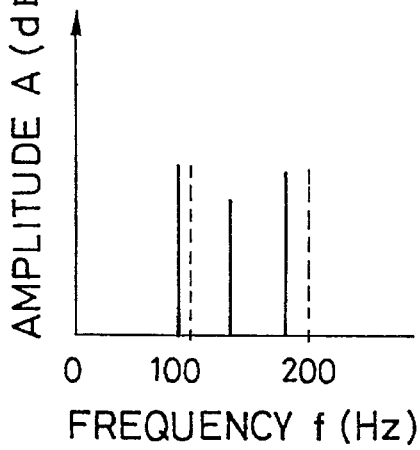

A transfer characteristic filter 81 corrects the dummy sound waveform (FIG. 10A) taking into account the transfer characteristic between the microphone 49 and the loudspeaker 51, and then the signal therefrom is fed to a silencing error identification adaptive filter 83 where a silencing error factor is identified. The result of such calculation is fed to a noise cancelling waveform generating filter 85 where each factor for electromagnetic sound 85*a* and rotation sound 85*b* is updated. The respectively factor-updated cancelling noises are compounded together to generate a final noise cancelling signal (FIG. 10E).

The silencing error identification adaptive filter 83 and the noise cancelling waveform generating filter 85 constitute control sound generating means. To differentiate processes on the electromagnetic sound and rotation sound, there is provided a switch 87 in the input side of the transfer characteristic filter 81 for switching between two different sound source signals. Then, the noise cancelling signal is radiated as cancelling noise inside the machine chamber 39 through the loudspeaker 51.

Accordingly, noise generated from the compressor 41 is attenuated significantly, excluding a machine noise component consisting of the fundamental wave component of the rotation frequency, by interfering with the noise cancelling sound from the loudspeaker 51 in the radiating opening portion 45*a*. Then, the machine noise component of the rotation frequency alone is radiated externally uncancelled. It is to be noted that the rotation frequency radiated externally is a sound with a frequency of less than 50 Hz which is practically an inaudible noise to human ears.

On the other hand, the noise which has reached the radiating opening portion 45*a* is detected by the microphone 49 also serving as a noise cancelling monitor. Then, if a monitored level of the noise excluding the fundamental wave component of the rotation frequency is greater than a predetermined level (that is to say that noise cancelling effect is small), an output level from the loudspeaker 51 is adjusted in a feedback manner such that the transfer factor is corrected. As a result, the noise of the compressor 41 is practically cancelled out at the radiating opening portion 45*a*.

Figure 11:
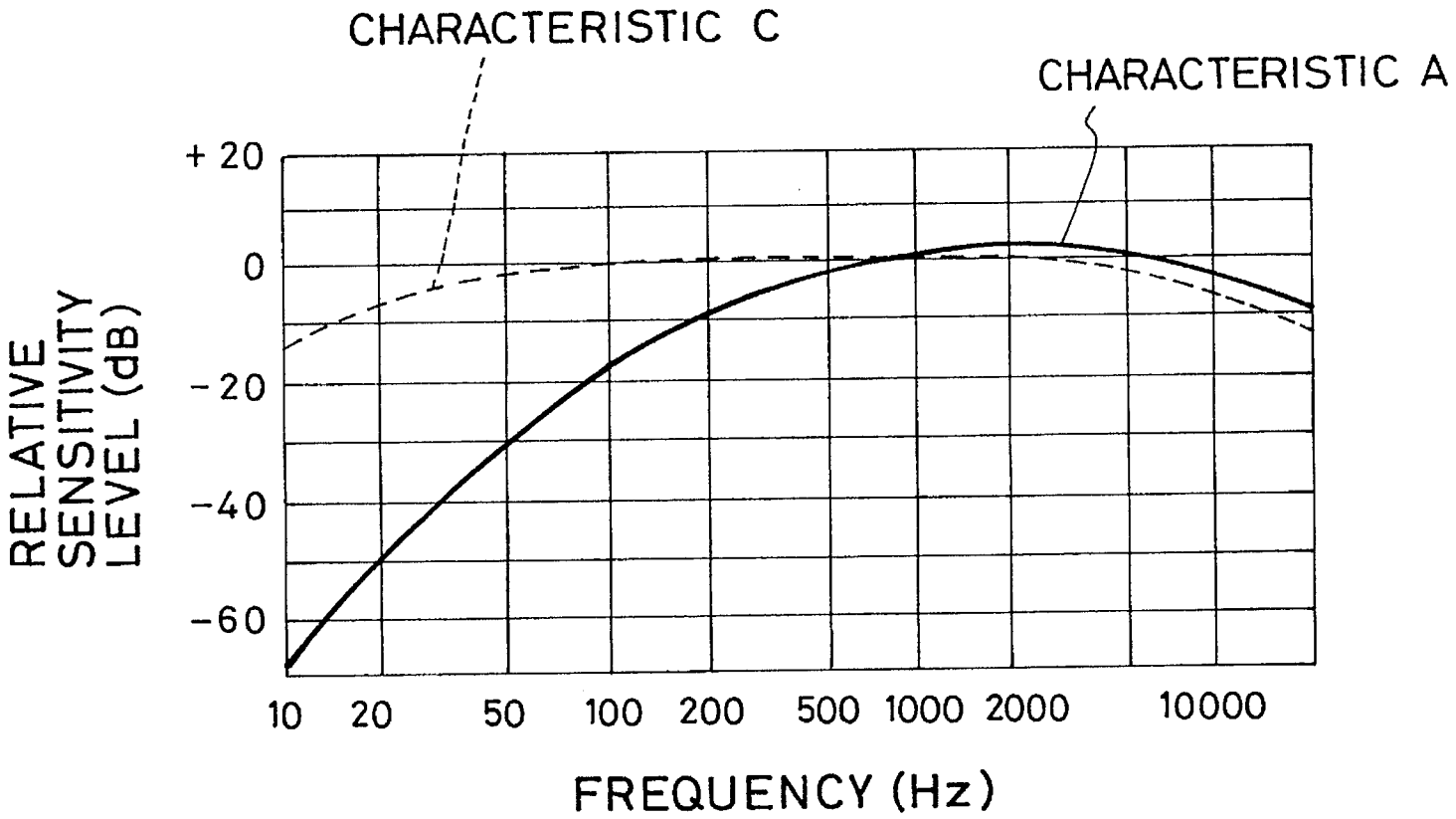
FIG. 11 shows a frequency corrected graph in which the noise level corresponds to the audible level for humans.

Referring to FIG. 11, a frequency band audible to human ears lies, in general, in the range between 10 Hz and 20,000 Hz, however, the sound in the frequency band is not heard under a same level of sound pressure. For instant, as illustrated as characteristic A in FIG. 11, under a silent range below 100 Hz, sensitivity to the sound declines as frequency thereof decreases, that is, it gets hard to hear as the frequency decreases. Now, if the power supply frequency in question is in the range of 50 to 60 Hz and a rotation drive portion of the noise source rotates in a speed in the neighborhood of the frequency thereof, a machine noise based on integral multiples of the frequency including the frequency corresponding to the rotation speed, as well as an electromagnetic noise based on even-integral multiples of the power supply frequency occurs. Thus, in this case, a noise component corresponding to the rotation frequency presents a lowest frequency, so that the noise component equivalent to the rotation frequency is practically not a recognizable noise.

Therefore, noise remained uncancelled is practically hardly noise to human ears, after the noise cancelling signal is generated to cancel the noise generated from the rotation drive portion of the noise source excluding the fundamental wave component of the rotation frequency. Accordingly, the noise is practically cancelled.

In the above embodiment, in the noise generated from the compressor 41, the machine noise is detected by the microphone 49 in a manner that the fundamental wave component of the rotation frequency detected by the microphone 49 is extracted by the band-pass filter 59 and the noise uncancelled excluding the fundamental wave component of the rotation frequency is extracted by the high-pass filter 79, the electromagnetic noise is detected in a manner such that the power supply frequency is detected by the power supply frequency detecting means 71, and the noise cancelling signal is generated by separately processing respective detection signals of the machine noise and electromagnetic noise. By adopting the configuration described thus far, the noise generated from the compressor 41 is securely prevented from being radiated outside the machine chamber 39 without causing howling and the active noise cancelling apparatus is realized economically compared to the case where the oscillator sensor is attached to the compressor 41.

Figure 12:
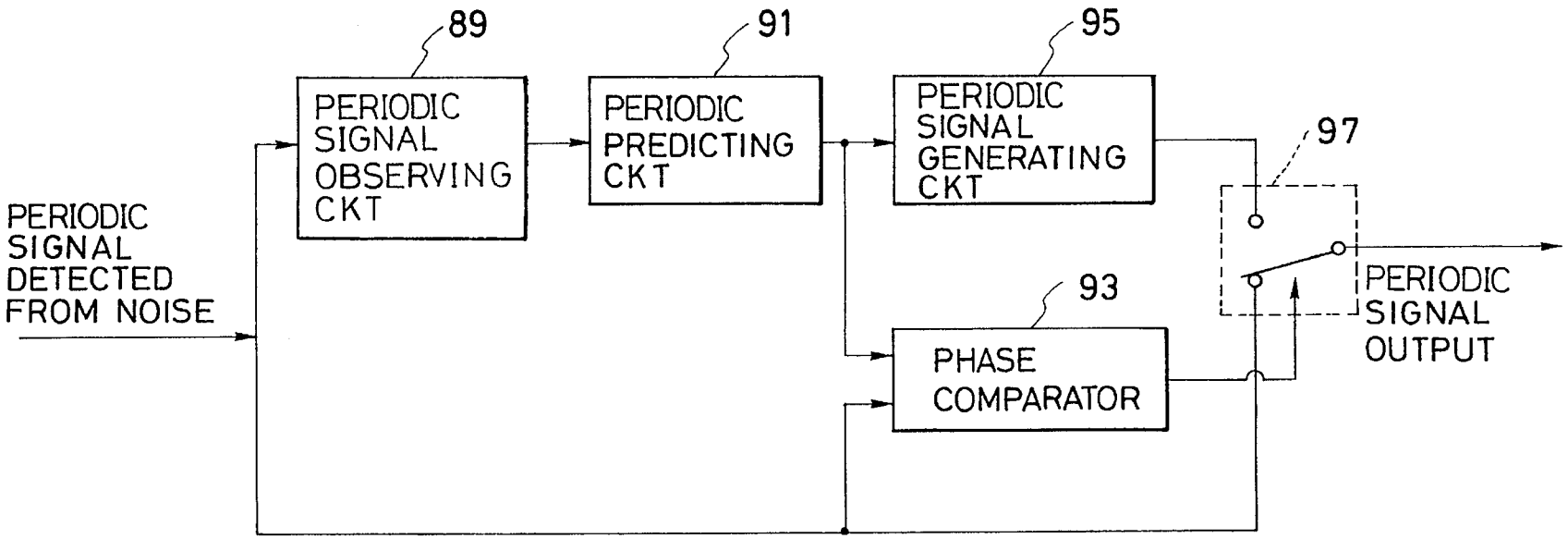
FIG. 12 shows a block diagram showing another embodiment of the sound source periodic signal stabilizing circuit shown in FIG. 7.

FIG. 12 shows another embodiment of the sound source periodic signal stabilizing circuit 63 in place of the PLL circuit shown in FIG. 7. In this embodiment, there are provided a periodic signal observing circuit 89 which observes a periodic signal responsible for the noise generated from the compressor 41 and which averages the signal over the time lapse, and a periodic signal predicting circuit 91 which predicts timing of subsequent periodic signals based on the result from the sound periodic signal stabilizing circuit 63. There are further provided a phase comparator circuit 93 which compares the predicted signal and the real periodic signal and then switches switching means 97, and a periodic signal generating circuit 95 which is electrically connected from the periodic signal predicting circuit as well as the phase comparator circuit 93 and is operative by the switching of the switching means 97 so as to be connected to a periodic signal output when the observed periodic signal is dislocated from the predicted periodic signal by predetermined amount of phase, thereby a stable noise cancelling with the phase fluctuation of the sound source being suppressed to a minimum is realized. Such configuration shown in FIG. 12 can be realized by either hardware or software as described with reference to FIG. 7. The periodic signal predicting circuit 91 and the periodic signal generating circuit 95 constitute periodic signal generating means, and the phase comparator circuit 93 and the switching means 97 constitute periodic signal output means.

Figure 13:
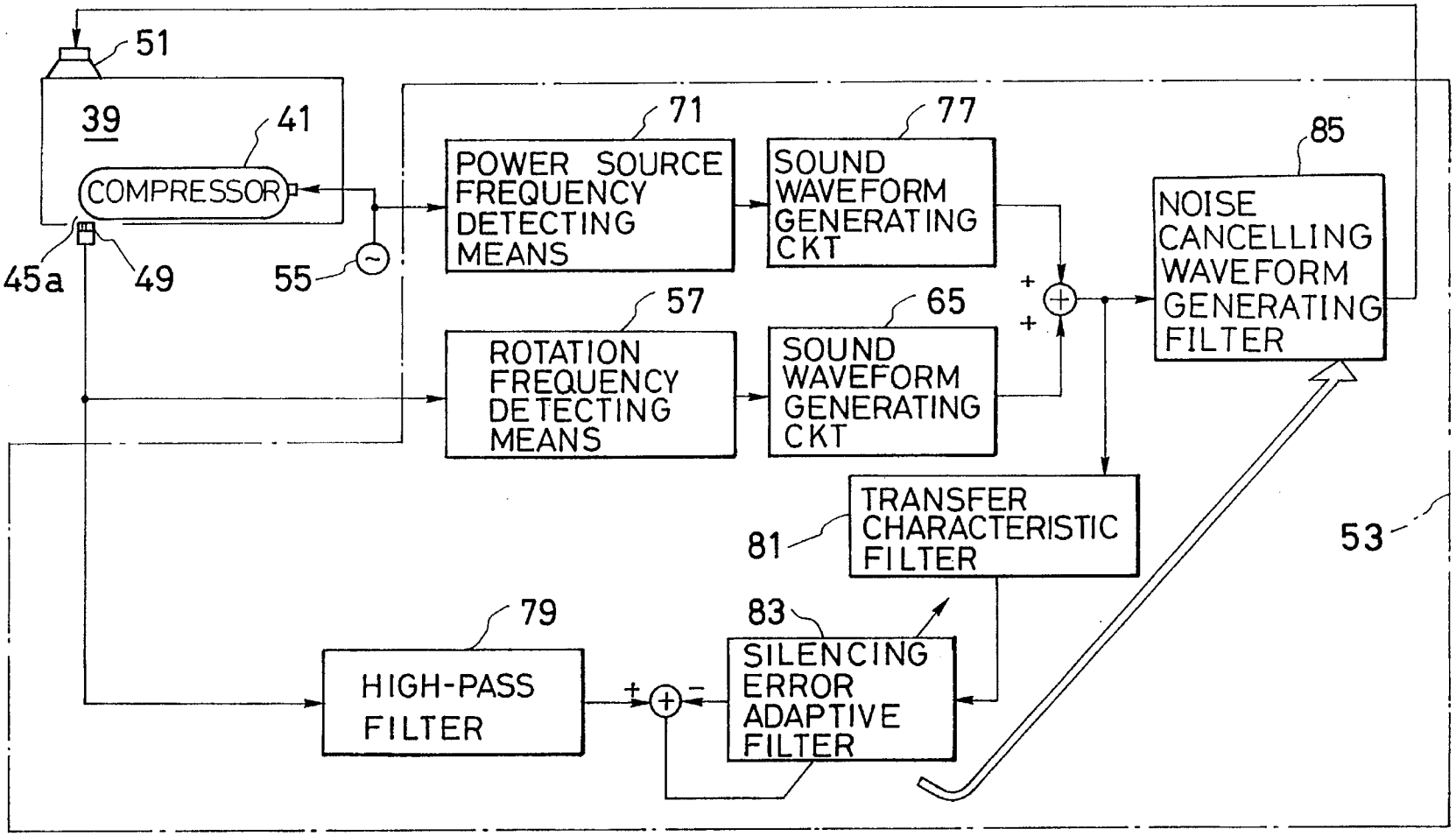
FIG. 13 shows an overview of the adaptive-type active noise cancelling apparatus according to another embodiment of the present invention.

FIG. 13 shows still another embodiment where the same elements as in FIG. 3 are labelled with the same reference numerals. In FIG. 3, for the final control noise-cancelling waveform to be outputted from the loudspeaker 51, two kinds of noise cancelling waveforms are formed through the noise cancelling waveform generating filter 85 based on respective sound source waveforms of the electromagnetic sound and the rotation sound, and then these respective noise cancelling waveforms are compounded together. In contrast to FIG. 3, in this embodiment the respective sound source waveforms of the electromagnetic sound and rotation sound are compounded together then the final control noise-cancelling waveform is formed through the noise cancelling waveform generating filter 85 based on the compounded sound source waveform.

In summary, there is provided sound detecting means disposed in the vicinity of the opening portion in the rotation drive portion which generates noises in which fundamental wave extracting means extracts the fundamental wave component of the rotation frequency generated from the rotation drive portion in order to generate the sound source waveform for cancelling the noise, and uncancelled sound extracting means extracts the uncancelled sound excluding the fundamental wave which is extracted by the fundamental component extracting means, thereby there will be no need for the conventional exclusive-use sound source detecting sensors such as a microphone and an oscillation pickup, realizing a stable noise cancelling control which is simple and economical and which does not cause howling.

Moreover, periodic signal generating means generates a periodic signal having correlation with the fundamental wave component extracted by the fundamental wave component extracting means, and the respective phases of the periodic signal and fundamental wave component are compared so that periodic signal output means outputs a desired periodic signal to power source generating means, whereby further stabilized sound source can be formed to achieve a sufficient noise cancelling effect.

Moreover, according to the present invention, for plural opening portions there are respectively provided control sound generating means and noise-cancelling level detecting means, and the respective control sound generating means are controlled so that the noise-cancelling level is held minimally sufficient. For example, even when there are many opening portions provided for compressor area (sound source) in a large-volume refrigerator, the present invention achieves to cancel noises properly.

Besides those already mentioned above, many modifications and variations of the above embodiments may be made without departing from the novel and advantageous features of the present invention. Accordingly, all such modifications and variations are intended to be included within the scope of the appended claims.

What is claimed is:

1. An active noise cancelling apparatus for actively controlling high frequency cyclic noise generated by a rotary machine, where noise is apt to externally leak from an opening portion of a machine chamber storing the rotary machine driven by an A.C. power supply, the apparatus comprising:

sound detecting means, provided in the vicinity of the opening portion, for detecting noise generated by the rotary machine;

fundamental wave component extracting means for extracting a fundamental wave component of rotation frequency of the rotary machine, from a sound signal of the noise detected by the sound detecting means;

periodic signal generating means for generating a periodic signal correlative to the fundamental wave component extracted by the fundamental wave component extracting means;

periodic signal outputting means for outputting a predetermined periodic signal by means of comparing a phase of the periodic signal generated by the periodic signal generating means with a phase of the fundamental wave component;

uncancelled sound extracting means for extracting noise having been not cancelled, after a control signal is outputted from control signal outputting means, excluding the fundamental wave component;

sound source waveform generating means for forming a harmonics component from the signal outputted by the periodic signal outputting means, the harmonics component being a sound source waveform which has a phase opposite to and a same amplitude with a sound source signal detected by the sound detecting means;

control signal generating means for correcting a control signal outputted from the sound source waveform generating means, based on a signal from the uncancelled sound extracting means and for generating the corrected signal in a feedback manner; and output means for outputting the control generated from the control signal correcting means.

2. The apparatus of claim 1, wherein the fundamental wave component extracting means comprises:

a band-pass filter which extracts a fundamental wave component of a rotation noise detected by the sound detecting means;

an A-D converter for digitizing a signal from the band-pass filter; and a sound source periodic signal stabilizing circuit for processing digitized signal output from the A-D converter to stabilize a periodic signal of the sound source.

3. The apparatus of claim 2, wherein the sound source periodic signal stabilizing circuit comprises in a feedback manner:

oscillating means for constantly generating a periodic signal;

phase compare means for comparing an output of the oscillating means and a periodic signal detected by the sound detecting means; and integrating means for controlling a phase of the oscillating means to coincide with the periodic signal detected by the sound detecting means, so that fluctuation of the periodic signal caused by external disturbance is eliminated.

4. The apparatus of claim 1, wherein the fundamental wave component extracting means includes power supply frequency detecting means for detecting a frequency of the A.C. power supply, the power supply frequency detecting means comprising:

full-wave rectifying means for doubling a voltage waveform of the power supply by full-wave rectification; and A-D converting means for binary-coding and digitizing a signal obtained by the full-wave rectifying means.

5. The apparatus of claim 1, wherein the uncancelled sound extracting means includes a high-pass filter for cutting off a fundamental frequency from a signal detected by the sound detecting means.

6. The apparatus of claim 1, wherein the control signal generating means comprises:

transfer characteristic filter means for correcting a fundamental wave component based on a transfer characteristic between the sound detecting means and the output means; and error identification adaptive filter means for identifying a noise-cancelling error factor.

7. The apparatus of claim 6, wherein there is provided switching means in an input side of the transfer characteristic filter means.

8. The apparatus of claim 6, wherein the control signal generating means further comprises:

noise cancelling waveform generating filter means to which a result of calculation obtained by the error identification adaptive filter means is fed, and where each factor for electromagnetic noise and rotation sound is updated, so that such factor-updated cancelling noises are synthesized so as to generate a final noise cancelling signal through the output means.

9. An active noise cancelling apparatus for actively controlling high frequency cyclic noise generated by a rotary machine, where noise is apt to externally leak from an opening portion of a machine chamber storing the rotary machine driven by an A.C. power supply, the apparatus comprising:

sound detecting means, provided in the vicinity of the opening portion, for detecting noise generated by the rotary machine;

fundamental wave component extracting means for extracting a fundamental wave component of rotation frequency of the rotary machine, from a sound signal of the noise detected by the sound detecting means;

periodic signal generating means for a periodic signal correlative to the fundamental wave component extracted by the fundamental wave component extracting means;

periodic signal outputting means for outputting a predetermined periodic signal by means of comparing a phase of the periodic signal generated by the periodic signal generating means with a phase of the fundamental wave component;

uncancelled noise extracting means for extracting noise having been not cancelled, after a control signal is outputted from control signal outputting means, excluding the fundamental wave component;

sound source waveform generating means for forming a harmonics component from the signal outputted by the fundamental wave component extracting means, the harmonics component being a sound source waveform which has a phase opposite to and a same amplitude with a sound source signal detected by the sound detecting means;

control signal generating means for correcting a control signal outputted from the sound source waveform generating means, based on a signal from the uncancelled sound extracting means and for generating the corrected signal in a feedback manner, wherein respective sound source waveforms of an electromagnetic sound detected from the A.C. power supply and a rotation sound of the rotary machine detected by the sound detecting means are synthesized so as to form a final control noise-cancelling waveform; and output means for outputting the control generated from the control signal correcting means.

10. An active noise cancelling apparatus for reducing noise emanating from a rotary machine driven in synchronism with a fundamental frequency comprising:

a microphone provided at a location where said noise is desired to be reduced;

a band-pass filter connected to said microphone in order to extract said fundamental frequency from the noise;

a sound waveform generating circuit connected to said band-pass filter for generating signals representing harmonic sounds of said fundamental frequency with half-wave phase differences;

a speaker provided adjacent to said rotary machine;

a driving circuit connected to said speaker and said sound waveform generating circuit for controlling said speaker to generate said harmonic sounds in accordance with the signals output from said sound waveform generating circuit;

a high pass filter connected to said microphone in order to detect harmonic components of sounds occurring at said location other than that having said fundamental frequency; and a silencing error adaptive filter connected to said driving circuit and said high pass filter to control said driving circuit to enhance cancellation of said noise at said location by said harmonic sound generated from said speaker in accordance with a transfer characteristic function rectified in accordance with said harmonic component detected by said high pass filter.

* * * * *